US006000184A

United States Patent [19]

Fernandes

[11] Patent Number: 6,000,184

[45] **Date of Patent: *Dec. 14, 1999**

[54] BASE FOR INSTALLING TILED COVERINGS AND METHOD FOR USE OF SAME

[76] Inventor: Gilbert R. Fernandes, 360 Patch Ave., San Jose, Calif. 95128

[ * ] Notice: This patent issued on a continued prosecution application filed under 37 CFR 1.53(d), and is subject to the twenty year patent term provisions of 35 U.S.C. 154(a)(2).

[21] Appl. No.: 08/638,902

[22] Filed: Apr. 24, 1996

[51] Int. Cl.[6] ..... E04F 13/08

[52] U.S. Cl. ..... 52/389; 52/426

[58] Field of Search ..... 52/384, 385, 386–388, 52/746.12, 747.1, 747.11, 747.12, 426

[56] References Cited

U.S. PATENT DOCUMENTS

| | | | |
|---|---|---|---|
| 1,071,467 | 8/1913 | Savage . | |
| 1,920,503 | 8/1933 | Hadley . | |
| 2,049,428 | 8/1936 | Denk | 52/384 |
| 2,484,240 | 10/1949 | Morthland . | |
| 2,860,505 | 11/1958 | Toulmin, Jr. . | |
| 3,045,396 | 7/1962 | Matyas | 52/384 |
| 3,521,418 | 7/1970 | Bartoloni . | |
| 4,223,501 | 9/1980 | DeLozier . | |
| 4,551,870 | 11/1985 | Presti, Jr. . | |
| 4,554,769 | 11/1985 | Fujii et al. | 52/388 |
| 4,916,875 | 4/1990 | Kashiwagi . | |
| 5,014,488 | 5/1991 | Evangelos et al. | 52/384 X |
| 5,226,273 | 7/1993 | Burke | 52/388 X |
| 5,238,721 | 8/1993 | Nakazawa | 52/385 X |
| 5,418,036 | 5/1995 | Tokikawa et al. . | |
| 5,438,809 | 8/1995 | Ehrlich . | |
| 5,483,776 | 1/1996 | Poppe . | |
| 5,501,049 | 3/1996 | Francis et al. | 52/384 X |

*Primary Examiner*—Beth Aubrey
*Attorney, Agent, or Firm*—Wilson, Sonsini, Goodrich & Rosati

[57] ABSTRACT

A base is provided for the installation of tiled coverings on unprepared underlying substrates and a method for using the base. The base has two substantially parallel surfaces, openings to permit the introduction of mortar between the base and the underlying substrate, fastening points for the use of mechanical fasteners to attach the base to the underlying substrate, and fixed or adjustable spacers to keep the base in proper alignment with the underlying substrate. One or more curved edges may be added to accommodate curved-edged tiled coverings, interlocking segments may be added to provide additional lateral support and a ledge may be added to assist in supporting the tiled coverings or for leveling purposes. Mortar may be introduced into the space between the lower surface of the base and the underlying substrate through openings in the base and the tiled coverings are attached to the mortar presented at the openings. Alternatively, the tiled coverings may be attached to the base using a mastic or adhesive and the installation accomplished without mortar.

12 Claims, 6 Drawing Sheets

BASE FOR INSTALLING TILED COVERINGS AND METHOD FOR USE OF SAME

FIELD OF THE INVENTION

This Invention relates to the construction trades in the fields of tile and masonry installations. More specifically, this invention relates to the preparation of an underlying substrate for the installation of tiled coverings.

BACKGROUND OF THE INVENTION

Many of the surfaces found in a modern building, are covered by tiled coverings such as ceramic tiles, slate tiles, decorative glass or mirror tiles or decorative mosaic tiles. The surfaces include floors, ceilings and walls inside the building, as well as floors, walkways, walls, pools and other similar surfaces outside the building. The installation of tiled coverings requires that the underlying substrate be prepared to provide a smooth, level and water-impermeable surface. The proper preparation of the underlying substrate requires significant skill and expertise. The current methods for preparation of the underlying substrate is very time consuming and laborious, increasing the time and cost associated with such installations.

In recent years there has been a significant trend towards homeowners performing maintenance, and even undertaking expansion projects, on their own without employing a professional. Numerous national and regional companies and stores cater to the owner-builders by providing products specifically designed for non-professionals. One area of home maintenance and construction that has largely remained the purview of professionals is the installation of tiled coverings, particularly on vertical surfaces. This is mainly due to the complexity of the traditional methods of installing tiled coverings.

In the current methods of installing tiled coverings, a substrate must be created to support the tiled coverings. There are two principal methods for creating the substrate: building up the underlying substrate or covering the underlying substrate with sheets of structural drywall.

When employing the first method, the preparation of the substrate begins by creating a moisture barrier by lining the area with lightweight building paper or similar material. Next, a combination of wire mesh, leveling sticks, and mortar is laid down over the moisture barrier. The wire mesh is cut into strips of proper size first and then nailed into place over the moisture barrier with special nails that incorporate a paper spacer. The result is that the mesh is stretched taught and spaced away from the moisture barrier. Wet mortar is then applied over the mesh. The mortar must be leveled and uniformly distributed over the entire surface. To assist in this process, one or more wooden strips are temporarily fastened to the surface. These wooden strips act as reference points for leveling the mortar to a uniform thickness. Once the mortar has been leveled, the wooden strips must then be removed and the resulting voids filled in. The final step is to attach the tiled coverings to the wet mortar and leveling the tiles individually to achieve a uniform and level appearance.

The use of structural drywall is an alternative to the procedure described above. Drywall is not as structurally sound as the method previously described, but may be acceptable depending on the type of installation. Water-resistant structural dry wall is generally available in rectangular sheets approximately 4'×8' feet in size. To be used as a substrate for installing tiled coverings, structural dry wall is first cut into strips of needed size and shape. The dry wall strips are then fastened to the underlying substrate with fasteners such as nails or screws. The tiled coverings are then attached to the dry wall strips. The main disadvantage of the use of dry wall as substrate is the lack of a moisture barrier. When exposed to moisture, dry wall material will decompose and lose structural integrity, leading to the failure of the installation.

In an attempt to reduce the susceptibility of the dry wall substrate installation to moisture, a concrete-type material has been substituted for the dry wall material using the dry wall installation method previously described. The main disadvantages of the concrete-type material for this type of installation are the high weight and the brittle nature of the material. The high weight of the concrete-type material makes it too heavy for certain applications such as prefabricated housing, mobile homes or marine applications. The brittle nature of the concrete-type material makes it difficult to cut or shape into proper-sized strips.

The installation of tiled coverings that are curved, or of irregular shape, creates significant challenges in the preparation of a substrate. For example, Radius tiles, tiles with a curved upper edge, are commonly used to create a decorative border at the base of a wall. When installing radius tiles, the substrate must be built up sufficiently to accommodate the curved edge of the tile. If the substrate is built up too much, a gap is created between the tile and the underlying substrate below the tile. If, the substrate is not sufficiently built up, the tile will not "sit" properly and the installation will be uneven and unsightly. Similar challenges exist for the installation of curved or irregularly shaped tiles.

The traditional methods for preparing an underlying substrate for the installation of tiled coverings require significant skill to execute properly. They are also time, and labor, intensive and unsuitable for non-professionals.

The difficulty inherent in the preparation of a suitable substrate for installation of tiled coverings has inspired attempts at facilitating certain aspects of the procedure. One such attempt is U.S. Pat. No. 2,852,932 issued in 1958 to S. J. Cable. The Cable '932 patent shows a tile and grouting assembly in which a frame or lattice is provided for retaining ceramic tiles in place. However, the Cable '932 assembly does not eliminate the need for extensive preparation of the substrate but merely eliminates the requirement for grouting between the tiles.

Another attempt in simplification of the installation of tiled coverings is seen in U.S. Pat. No. 3,521,418 issued in 1970 to Bartoloni. The Bartoloni '418 patent shows a pre-finished decorative rigid panel in which tiles are set on a fibrous backing that is impregnated by a plastic resin to bond the tiles to the backing support. However, while the Bartoloni '418 patented panel shows fixing of the tiles in a desired pattern, it may not adequately eliminate the need for preparation of an underlying substrate, especially if the panel is to be installed above a relatively flexible wooden floor and thereafter subjected to localized loading stresses. Also, the Bartoloni '418 patented tile panels do not include means for interlinking adjacent panels or absorbing stresses between adjacent panels.

Another approach can be found in U.S. Pat. No. 4,551,870 issued in 1985 to Presti, Jr. The Presti '870 patent shows a modular form used as a base for building shower stall thresholds. The form is constructed from two opposed former sections formed of light plastic material and adapted to have mortar poured in the space between the former sections. Tiles are attached to the outside of the former section by adhering them to mortar exposed through openings in the former sections. The approach of the Presti '870 patent is limited to constructing shower stall thresholds and the use of pairs of opposed former sections makes the approach unsuitable for direct installation of tiled coverings on flat surfaces. There is also no provision for attaching the former sections directly to the underlying substrate, making the use of mortar a necessary step of each installation.

A further approach to simplifying the installation of tiled coverings appears in U.S. Pat. No. 5,438,809 issued in 1995 to Gernot Ehlrich. The Ehrlich '809 patent teaches a modular flooring system consisting of units comprised of tiles affixed to a backing material and surrounded by a frame. Adjacent units are joined together by elongate strips. This approach, however is limited to installing tiles on horizontal surfaces, such as the floor. This approach relies on the existence of a frame to provide additional support to the tiles and is therefore unsuitable for trim tile installations which consist of one or two rows of tiles installed at the intersection of a wall and the floor or the coping of a swimming pool. Finally, the Ehlrich '809 patent does not address the installation of radius tiles.

Neither the traditional approaches, nor the approaches disclosed by the patents discussed above provide a general purpose product, or method, that can be used for the installation of tiled coverings directly on an unprepared surface.

Furthermore, the traditional approach of using sticks as leveling guides for leveling mortar applied to an underlying substrate is also time consuming and requires great skill to execute. The filling of voids and re-leveling of the mortar after the sticks are removed is a difficult and skill-intensive procedure unsuitable for non-professionals.

Therefore, the need exists for a product that facilitates the preparation of an underlying substrate for the installation of tiled coverings in a manner which reduces the time, labor and expense associated with the installation of tiled coverings and makes it possible for the homeowners who are not professional builders to successful complete tiled covering installation projects.

A further need exists for a product that provides a permanent, embedded leveling guide for wet mortar applied to a surface, which will eliminate the need for the use of temporary guides made from wooden strips.

SUMMARY OF THE INVENTION

It is an object of this invention to provide a product that may be used as a base for installing tiled coverings on an underlying substrate more easily and more efficiently than existing techniques.

It is a separate object of this invention to provide, in a preferred embodiment of this invention, a product that may be used as a base for installing curved-edge or "radius" tiled coverings more easily and more efficiently than existing techniques.

It is a separate object of this invention to provide, in a preferred embodiment of this invention, a method for installing tiled coverings, using the base easily and quickly.

This invention provides a way to install tiled coverings over a substrate quickly and easily using a base that is attached to the substrate and upon which the tiles are laid.

In one embodiment of this invention a base is provided, the base having a front and a back surface, one or more openings between the upper and lower surfaces, one or more fastening points to permit the attachment of the base to the underlying substrate, and one or more spacers on the lower surface of the base.

In a separate embodiment of this invention, the base includes one or more curved edges designed to cooperate with the curved edges of curved, or "radius", tiled covering.

In a separate embodiment of this invention, the base includes one or more interlocking connectors on one or more edges. The interlocking connectors of adjacent bases provide a positive connection between the adjacent bases enabling each base to provide mutual lateral support to its adjacent counterpart thereby increasing the lateral rigidity and stability of the overall installation.

In a separate embodiment of this invention, one or more bases are attached to the underlying substrate by mechanical fasteners, such as nails, screws or bolts. Mortar is then packed into the space between the base and the underlying substrate and permitted to extend through the openings to the front surface of the base. Tiled coverings are then attached to the mortar extending through the openings by pressing the tiled covering against the upper surface of the base.

In a separate embodiment of this invention, the base is attached to the underlying substrate by mechanical fasteners, and the tiled coverings are attached to the upper surface of the base using a mastic or adhesive compound. Using this method, no mortar is required for the installation of tiled covering.

It is a separate object of this invention to provide, in a preferred embodiment of this invention, a product that may be used as a permanently embedded leveling guide for wet mortar being applied to a surface, which leveling guide eliminates the need for using temporary guides during the leveling process.

In a separate embodiment of this invention, the base includes a ledge built on the front surface of the base to support the tiled coverings, or to provide a leveling guide for mortar.

In a separate embodiment of this invention, one or more bases incorporating a ledge are attached to the underlying substrate using mechanical fasteners. Mortar is then applied to the underlying substrate and the ledge of the base, or bases, attached to the underlying substrate is used as guide to level the surface of the mortar.

The invention and its particular features and advantages will become more apparent from the following detailed description considered in conjunction with the accompanying drawings.

DETAILED DESCRIPTION OF THE INVENTION

Figure 1:
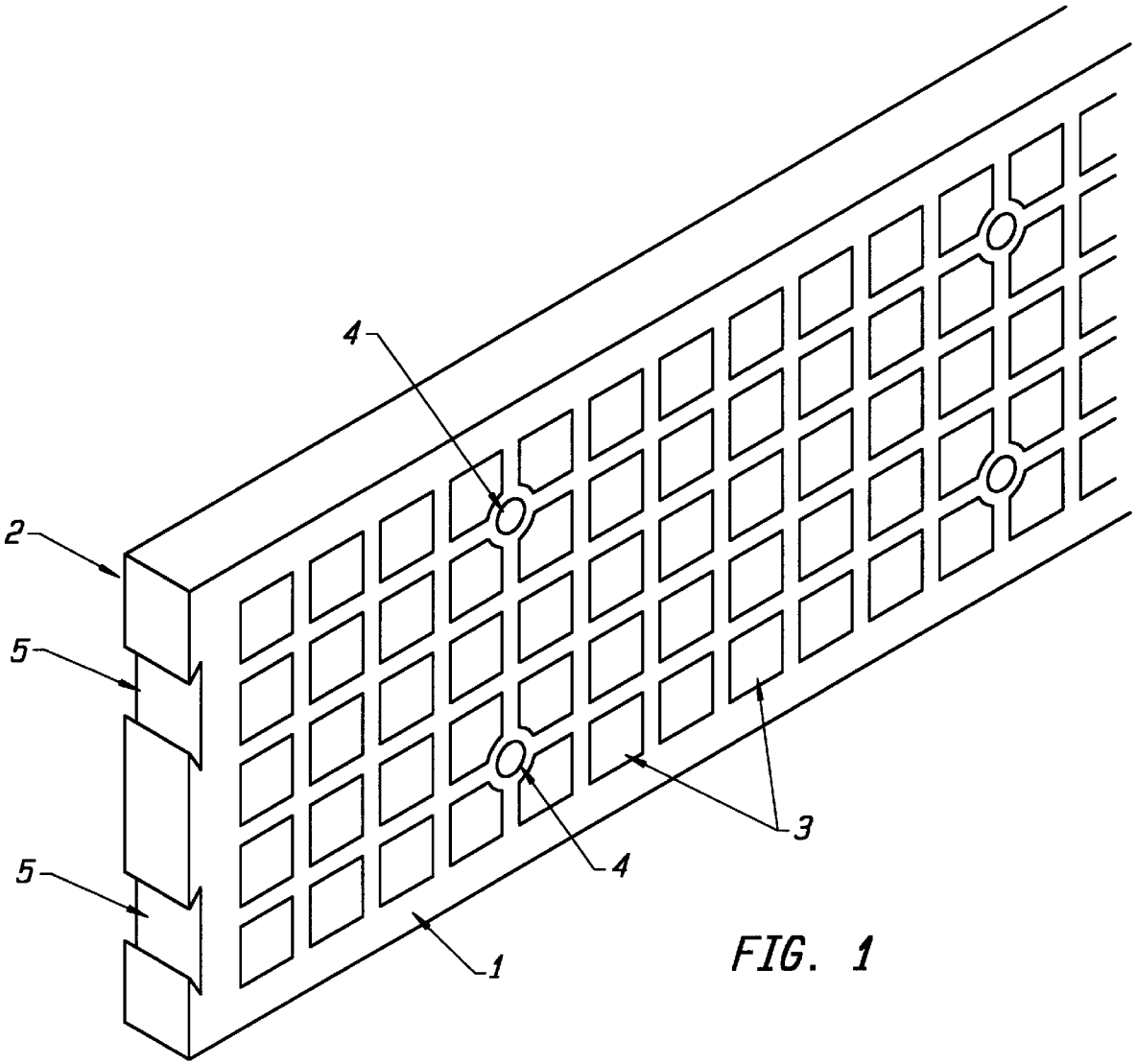
FIG. 1 is a perspective view of the preferred embodiment for the base illustrating the front surface, the openings, the fastening points and the interlocking segments.

This invention provides a base for the installation of tiled coverings on an underlying substrate, such a wall, floor, or a ceiling inside or outside a building, without the need for extensive preparation of the underlying substrate. Tiled coverings are any type of covering material that may be divided up into tiles and installed on a surface by placing the tiles adjacent to one another. Examples of tiled coverings include ceramic tiles, slate tiles, natural or artificial stone tiles, mirror tiles or decorative mosaic tiles.

The base comprises a backing that is generally rectangular in shape and provides the attachment point for the tiled coverings. The backing has a front surface (1) and a back surface (2). The tiled coverings are attached to the front surface of the backing, therefore the front surface of the backing is shaped to cooperate with the shape of the tiled coverings to be supported by the base. Flat tiles, for example would generally be placed on a flat front surface, while curved tiles would be best supported by a curved front surface. The back surface is usually shaped, in conjunction with the spacers described below, to cooperate with the underlying substrate. The backing is a portion of the base, therefore the front surface of the backing is also the front surface of the base and the back surface of the backing is also the back surface of the base.

The base is generally made from a material that is sufficiently rigid to support the weight of the tiled coverings without significant distortion, yet sufficiently light that the base may be easily transported and installed. Injection-molded plastic is typically used for manufacturing the base, however other strong and lightweight material, such as ceramics or composites or similar material may also be used.

The degree of rigidity of the base may vary based on whether mortar is used to install the tiled coverings. In an installation where mortar is used, when the mortar hardens, it imparts rigidity to the base and therefore the base may be made flexible to facilitate installation. If no mortar is used, the base itself must be sufficiently rigid to support the weight of the tiled covering without substantial deformation. The shape of the base and the distance between the front and back surfaces of the base may vary to cooperate with the shape, texture and weight of the tiled covering to be supported by the base as well as the material and contour of the underlying substrate. The color of the material from which the base is made may also be varied as required.

The two surfaces of the base are usually substantially parallel to one another. There are openings (3) between the two surfaces to permit the introduction of mortar and to reduce the weight of the base. The size of the openings should be large enough to permit easy introduction of mortar and small enough to retain the mortar packed between the back surface of the base and underlying substrate. The size of the opening, or openings, is also limited by their effect on the structural integrity of the base. The size and shape of the openings may be either uniform or varied.

One or more of the openings between the front and back surfaces of the base may be used as fastening points (4). Mechanical type fasteners such as nails, screws or bolts (10) may engage the underlying substrate through the fastening point and attach the base to the underlying substrate. The fastening points may be of the same shape and size as the openings between the front and back surfaces of the base, or they may be of a different size and shape. For economy of design and construction, the base may be manufactured such that substantially all openings between the front and back surface of the base may be used as fastening points.

The fastening points may be placed at intervals that correspond to the intervals of structural features in the underlying substrate which can support the base and the tiled coverings. Such features include studs and load bearing columns, and the interval between such features is generally regulated by local building codes or state or national regulations. The interval between the fastening points on the base, between adjacent bases, is keyed to the applicable codes and regulations regulating the placement of the structural features described above.

The spacers (8) are part of the back surface, projecting out from the back surface in the direction of the underlying substrate. When the base is attached to the underlying substrate the spacers contact the underlying substrate and maintain a gap between the back surface of the base and the underlying substrate. Generally, the spacers are uniform is size and distribution, although both the size and distribution of the spacers may be varied to permit the base to cooperate with the underlying substrate to align the upper surface of the base with the desired plane for the installation of the tiled coverings.

Figure 6:
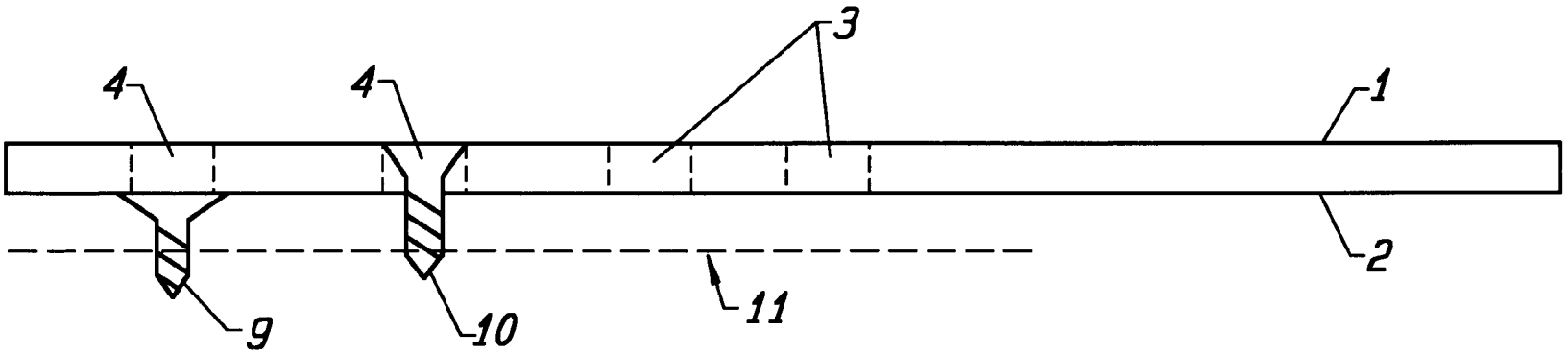
FIG. 6 is a planar view of an alternative embodiment of the base, featuring an adjustable spacer.

As shown in FIG. 6, the spacers may also consist of mechanical fasteners such as nails or screws attached to the underlying substrate and each having a top which supports the back surface of the base (9). The top of the mechanical fasteners forming the spacers in this embodiment may be sufficiently exposed through an opening in the base to permit the distance between the base and the underlying substrate to be adjusted during and after installation such that the front surface of the base may be placed in a desired plane irrespective of the contour of the underlying substrate.

During installation, the base is attached to the underlying substrate through attachment points built into the base. In one preferred embodiment, mortar may be introduced into the space between the base and the underlying substrate and the tiled coverings may be attached to the mortar presented at the openings on the base. The mortar fills the gap between the base and the underlying substrate and attaches to the tiled covering placed on the base. The mortar comes into contact with the tiled covering through the openings in the base. When the mortar hardens it creates a firm bond between the underlying substrate, the base and the tiled coverings. Although the use of mortar is not required in all installations, it may be employed when deemed advantageous.

In an alternative embodiment, after the base is attached to the underlying substrate, the tiled coverings may be attached to the base using a mastic or adhesive and the installation accomplished without mortar.

The tiled coverings adhere to the mortar that fills the space between the base and the underlying substrate and which is presented through the openings in the base. Alternatively a mastic can be used to adhere the tiled coverings directly to the front surface of the base, thus eliminating the need for mortar. Generally, however, any bonding agent, such as mastic, adhesive or mortar may be used to attach tiled coverings to the front surface of the base.

Bases can be placed adjacent to one another to cover a large surface. The bases can be manufactured in different shapes and sizes to accommodate various types of installations. The bases may be made from material of different color to match the tiled covering or mortar that is used in the installation.

The front surface of the base provides a clean surface, shaped to cooperate with the shape of the tiled coverings used. Flat tiles, for example would typically use a flat base for installation, while curved tiles would best be supported by a curved base.

The use of a base attached to the underlying substrate using mechanical fasteners eliminates the time consuming preparation of the underlying substrate required by the earlier methods. It permits relatively inexperienced individuals to install tiled coverings perfectly. In some installations, it eliminates the need to apply mortar to the surface. The elimination of mortar leads to a lighter, faster, easier and consequently more inexpensive installation.

Certain tiled coverings have a curved or 'radius' edge or edges. For example, the tiles used to create a decorative border at the base of a wall have a curved upper edge. For the proper installation of radius tiles, both the flat body and the curved edge, or edges, of the tile must be adequately supported by the underlying substrate, or the base of this invention.

One embodiment of the base would include one or more curved edges designed to cooperate with the curved edge or edges of a radius tile. The curvature of a single edge makes this embodiment of the base, when viewed from the side, resemble the body of the letter "j". The curved edge may be manufactured to be integral to this embodiment of the base, or it can be manufactured as a separate section having the desired curvature that is attached to a base prior to, or during installation. The separate curved edge may also be installed separately on the underlying substrate without being attached to a base. When the curved edge or edges are manufactured as integral parts of the base, a weakened section may be provided to facilitate the separation of the curved edge from the base, if desired.

Figure 2:
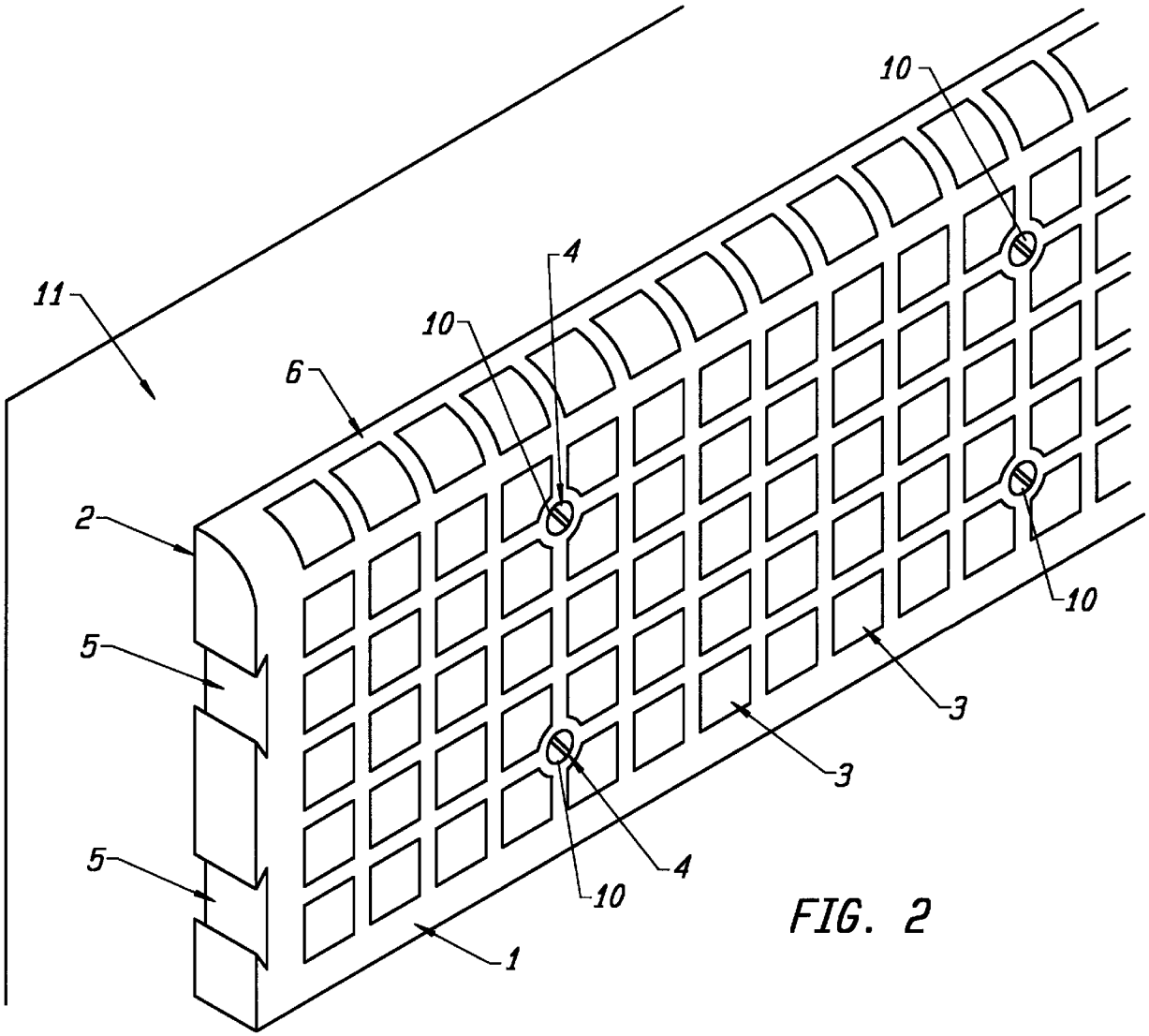
FIG. 2 is a perspective view of an alternative preferred embodiment of the base additionally featuring a curved edge.
Figure 3:
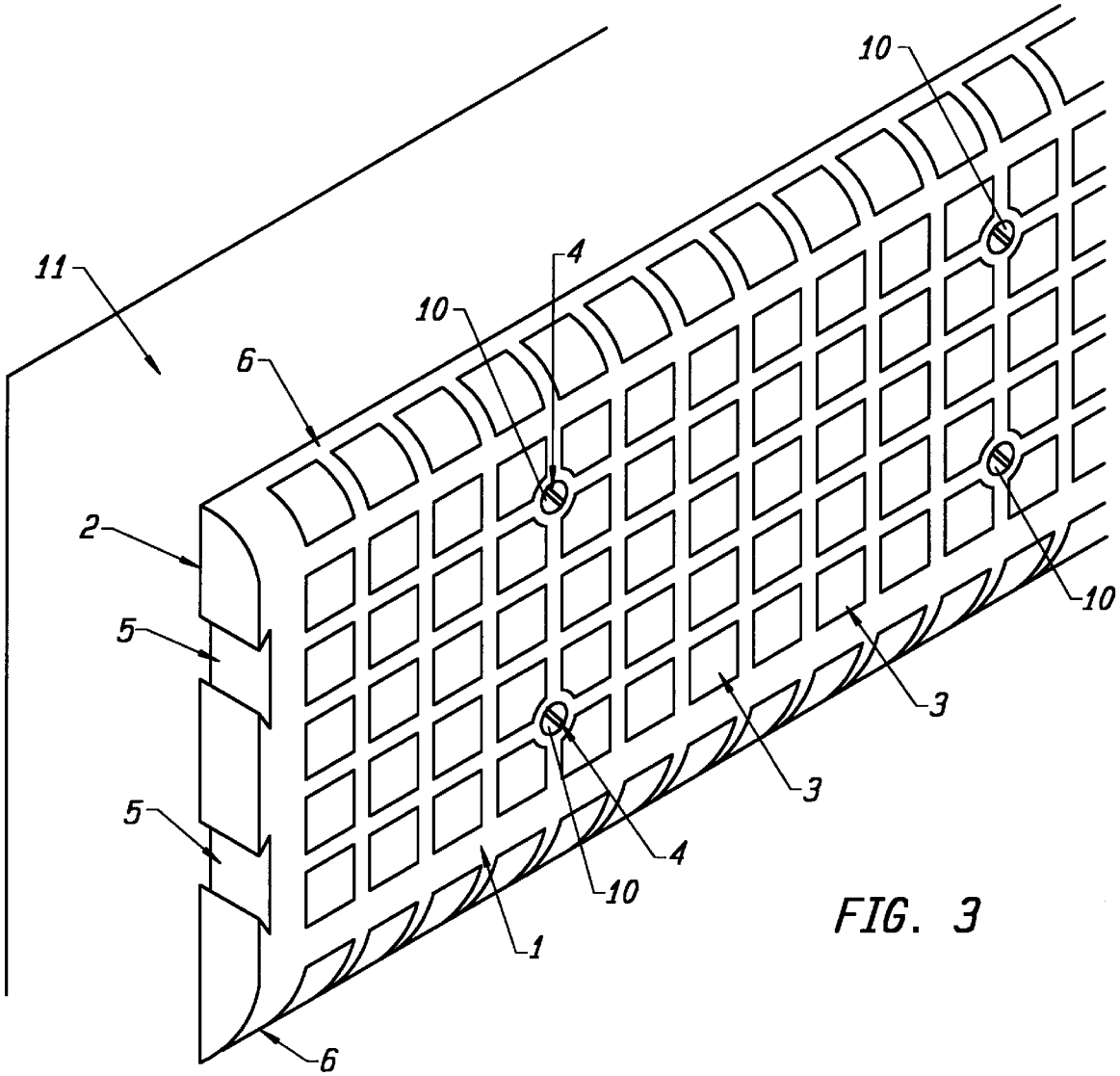
FIG. 3 is a perspective view of an alternative preferred embodiment of the base, additionally featuring two curved edges.

This alternative embodiment of this invention, (FIGS. 2 and 3) provides a base having one or more curved edges (6) to support the curved edges of radius tiled covering. The curvature of the curved edge, or edges, is designed to cooperate with the curved edge or edges of the tiled coverings installed on the base. Different curvatures are possible depending on the requirements of the tiled coverings being installed. Each curved edge of the alternative embodiment provides support for the corresponding curved edge of the tiled covering. The use of this embodiment eliminates the need to build up the underlying substrate to conform to the shape of the radius tiled covering, which is a far more complex and error-prone task than the preparation of the substrate for the installation of flat tiled coverings.

When a base of this invention includes a radius edge, all the advantages of the principal invention can benefit the installation of curved or radius-edged tiled coverings. The use of the base with a radius edge eliminates the need to prepare and build up the underlying substrate for the specific shape of the radius-edged tiled coverings. The use of this alternative embodiment permits installation of radius tiled coverings by relatively inexperienced individuals and achieving results hitherto obtained by experienced professionals only. The use of this alternative embodiment by a professional can significantly reduce the time and expense associated with the installation of radius tiled coverings.

Figure 4:
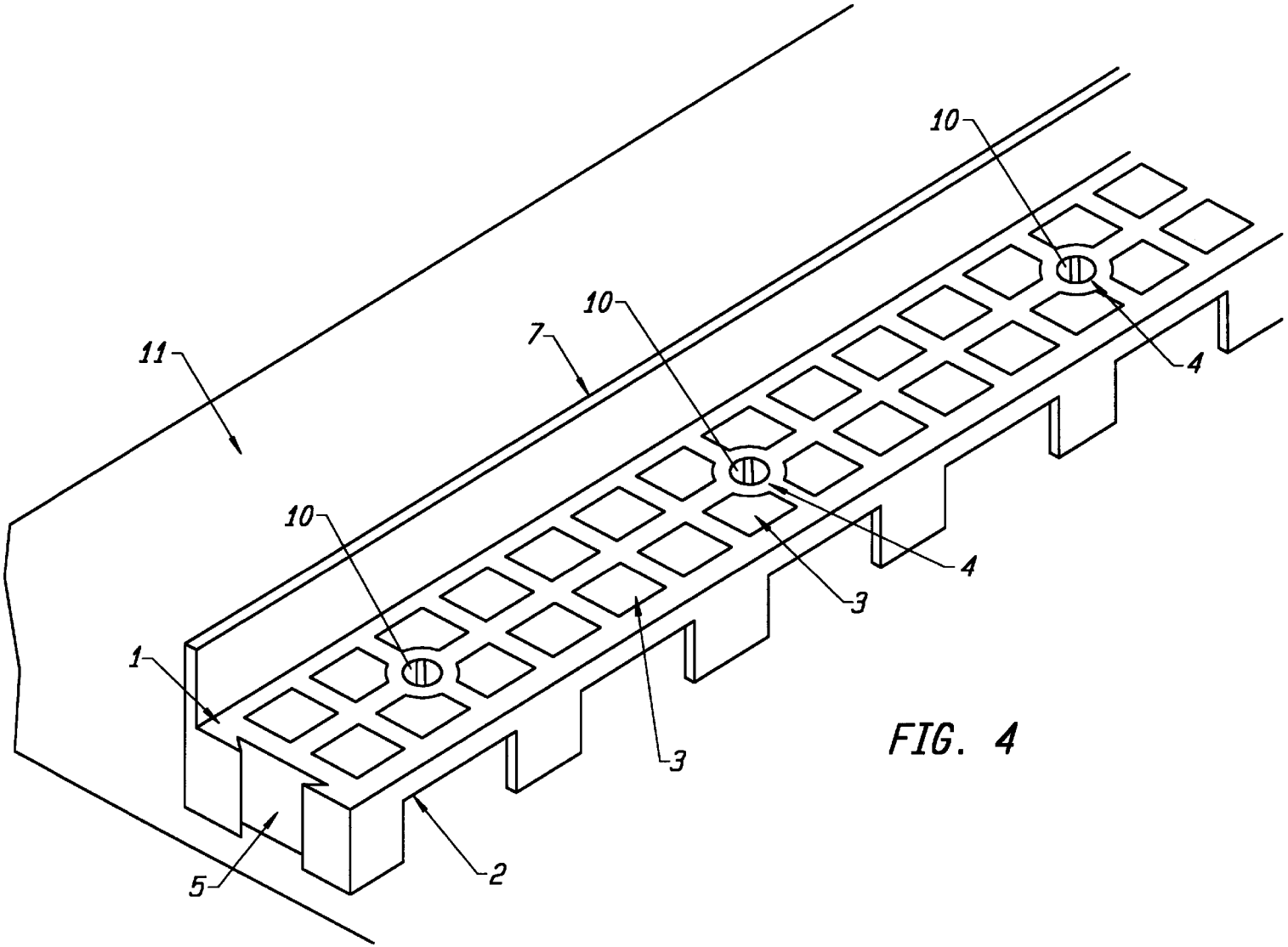
FIG. 4 is a perspective view of an alternative preferred embodiment of the base, additionally featuring a ledge.
Figure 5:
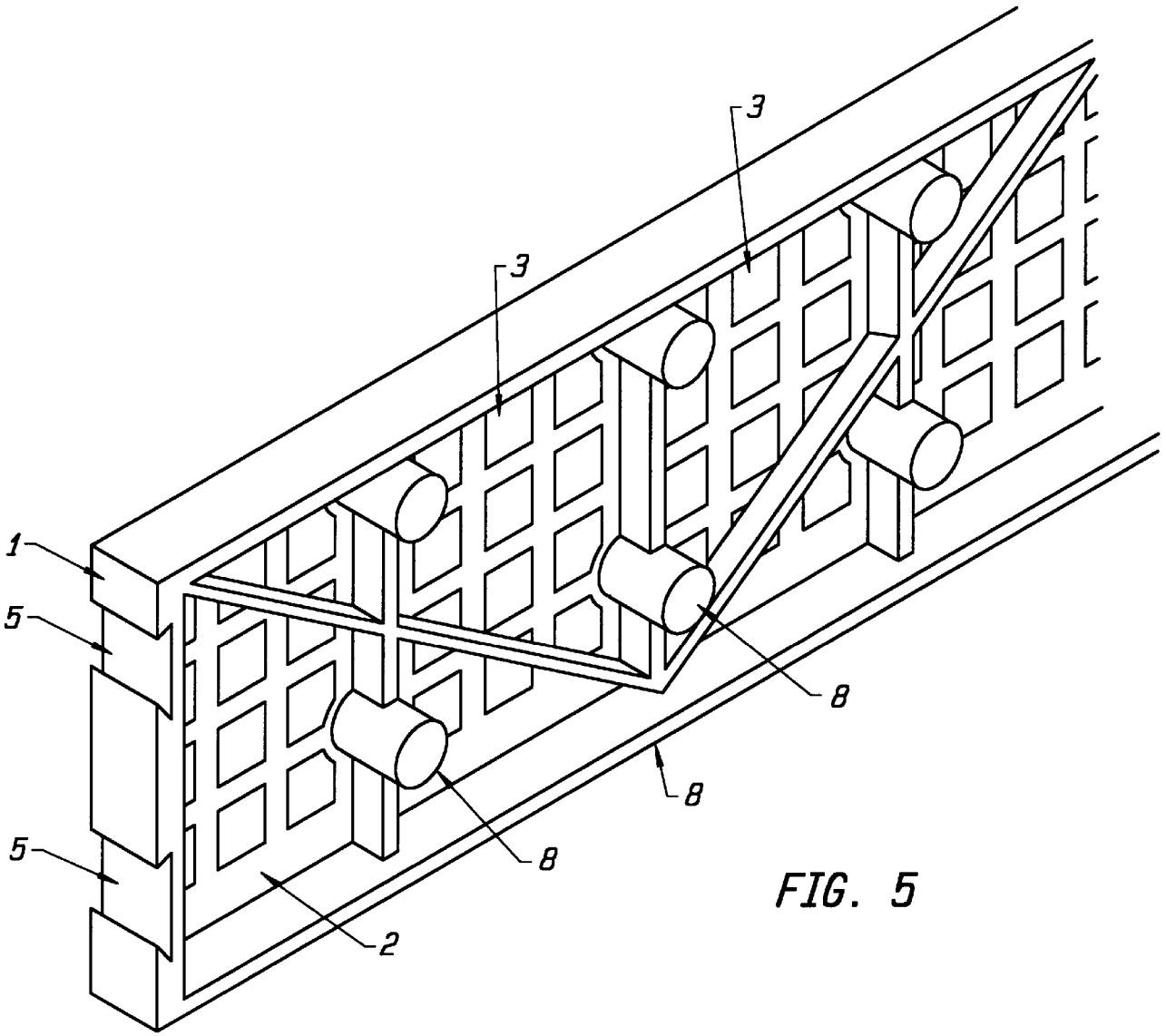
FIG. 5 is a perspective view of the back surface of the preferred embodiments, illustrating the spacers attached to the back surface of the base.

An alternative embodiment of this invention includes a ledge (FIG. 4). The ledge (7) is part of the front surface of the base that is built up to a selected distance from the front surface. The ledge is generally built up to a right angle from the front surface of the base, although any other angle may be selected if desired. The ledge serves two discrete functions: it may be used to cooperate with the bottom edge of tiles attached to the base, or it may be used as a guide for leveling mortar. The ledge is generally made from the same material as the base itself, but if needed, it can be made from a different material to achieve a different degree of rigidity, different color or other unique properties required by the particular tiled covering or installation.

The use of a ledge to support the bottom edge of tiled coverings provides for a more convenient installation. When the tiled covering is attached to the base in substantially vertical orientation, the tiles are preferably supported while the mortar, or mastic, is drying. If the consistency of the mortar is not precisely controlled during the traditional installation techniques, the tiled coverings may simply fall off the wall before the mortar is dry. A support ledge prevents the tiled coverings from falling and gives the mortar or mastic a chance to adhere to the tiled coverings. In effect, the use of the base with the ledge makes the installation process more forgiving to errors, thus making it possible for individuals with relatively little experience to achieve professional-like results.

The preferred embodiment featuring a ledge may also be used as a leveling guide for wet mortar. In this application, the base is attached to the underlying substrate with mechanical fasteners such as nails, bolts or screws with the back surface facing the underlying substrate. The mortar is then applied to the underlying substrate, such as a wall or floor in sufficient depth to cover the base and the ledge. The tip of the narrow edge of the ledge can then be used as a guide to level the mortar using a straight edge, 2-by-4 plank or other suitable tool.

An alternative embodiment of the base includes interlocking segments along the edge of the base that permit each base to be securely connected to one or more adjacent bases. The typical interlocking mechanism is a tongue and groove connector, although other types of interlocking mechanisms may also be used. The interconnection of adjacent bases creates a more rigid overall surface for the installation of tiled coverings. The base of this invention may be manufactured in standard sizes and shapes. Preferably, the interlocking segments are standardized and would permit bases of different shapes and sizes to be attached to one another. The ability to attach adjacent bases of same or different shapes and sizes together allows great variety in the size, shape and contour of the area to be covered by tiled coverings. The use of interlocking segments preserves sufficient flexibility in the overall base surface to accommodate the normal flexing of the underlying substrate and the tiled covering while providing enhanced overall rigidity to the installation.

The features of various alternative embodiments of this invention may be combined in numerous variations to create bases for particular installations and requirements. For example, one such combination may consist of a base with curved upper edge and a ledge but no interlocking segments. Other variations are also possible combining the features described to form specific base configurations.

Although the invention has been described with reference to a particular arrangement of parts, features, steps and the like, these are not intended to exhaust all possible arrangements or features. Many other modifications and variations will be ascertainable to those skilled in the art.

What is claimed is:

1. A base for attaching tiles to an existing rigid substrate, the base comprising:

a) a front surface for attachment of the tiles;

b) a back surface, c) at least one opening between the front surface and the back surface;

d) at least one fastening point, at least one mechanical fastener received in the at least one fastening point for rigidly attaching the base to the existing rigid substrate prior to the attachment of the tiles to the front surface; and c) at least one spacer on the back surface to space the base from the existing rigid substrate.

2. The base of claim 1 further comprising at least one curved edge for supporting tiles having at least one curved edge respectively.

3. The base of claim 1 further comprising at least one ledge on the front surface of the base.

4. The base of claim 2 further comprising at least one ledge on the front surface of the base.

5. The base of claim 1, 2, 3, or 4 further comprising at least one vertical or horizontal interlocking segment, wherein each said interlocking segment is connectable to a respective vertical or horizonal interlocking segment of an adjacent base.

6. An assembly of bases comprising at least two bases of claim 5, said bases being located vertically or horizontally adjacent to one another and connected to one another through said interlocking segments.

7. The base of claim 5 wherein at least one of the spacers is adjustable to permit leveling the base after attaching the base to the existing rigid substrate.

8. The base of claim 1, 2, 3, or 4 wherein the base is rigidly attached substantially parallel to the existing rigid substrate.

9. A method of installing tiles onto a base and over an existing rigid substrate, said method comprising the steps, in sequence, of a) rigidly attaching at least one base of claim 1, 2, 3, or 4 to the existing rigid substrate with the at least one mechanical fastener such that said back surface is adjacent to the existing rigid substrate; and b) placing at least one tile onto the front surface of the base with a bonding agent applied between the tile and front surface of the base and with a force such that the tiles adhere to the base.

10. The method of claim 9 wherein the base is leveled by adjusting at least one spacer to level the base prior to applying the bonding agent to the front surface.

11. A method for installing tiles onto a base and over an existing rigid substrate, said method comprising the steps, in sequence, of a) applying a bonding agent to the front surface of the base of claim 1, 2, 3, or 4;

b) placing at least one of the tiles onto the front surface of the base with a bonding agent and with a force such that the tiles adhere to the base;

c) rigidly attaching the base to the existing rigid substrate with at least one of the mechanical fasteners through at least one fastening point such that said back surface is substantially adjacent to the existing rigid substrate; and d) placing any remaining tiles onto the front surface of the base with the bonding agent and with sufficient force such that the remaining tiles adhere to the base.

12. A method for using a base having a ledge to level mortar on an existing substrate, said method comprising:

rigidly attaching at least two bases of claim 3 to an existing substantially horizontal or substantially vertical substrate with at least one mechanical fastener;

(b) applying mortar to the existing substrate to at least a depth sufficient to cover the ledge;

(c) placing onto the ledges a leveler having a length sufficient to span at least the distance between said two ledges; and (d) moving the leveler across the ledges while maintaining contact between the leveler and the ledges, thereby leveling the mortar.

* * * * *